US011802377B2

(12) United States Patent
Nakazawa et al.

(10) Patent No.: US 11,802,377 B2
(45) Date of Patent: Oct. 31, 2023

(54) FIBROUS BODY MANUFACTURING METHOD AND FIBROUS BODY MANUFACTURING APPARATUS

(71) Applicant: SEIKO EPSON CORPORATION, Tokyo (JP)

(72) Inventors: Masahiko Nakazawa, Nagano (JP); Shigemi Wakabayashi, Nagano (JP); Yoshihiro Ueno, Nagano (JP); Naotaka Higuchi, Fujimi-machi (JP); Hiroki Kurata, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 23 days.

(21) Appl. No.: 17/405,090

(22) Filed: Aug. 18, 2021

(65) Prior Publication Data

US 2022/0056642 A1 Feb. 24, 2022

(30) Foreign Application Priority Data

Aug. 20, 2020 (JP) ..... 2020-139191

(51) Int. Cl.
*D21H 21/18* (2006.01)
*D21H 11/14* (2006.01)

(52) U.S. Cl.
CPC ..... *D21H 21/18* (2013.01); *D21H 11/14* (2013.01)

(58) Field of Classification Search
CPC ..... D21H 21/18; D21H 11/14; D21H 11/12; D21H 17/28; D04H 1/732
See application file for complete search history.

(56) References Cited

U.S. PATENT DOCUMENTS 3,781,150 A * 12/1973 Matsumura ..... D21H 15/06 425/73
3,895,089 A * 7/1975 Goyal ..... D04H 1/732 19/302
3,984,898 A * 10/1976 Matsumura ..... D21H 5/2642 19/94
4,425,126 A * 1/1984 Butterworth ..... A61B 46/40 428/17
6,231,976 B1 * 5/2001 Dean ..... D04H 1/43835 525/445

(Continued)

FOREIGN PATENT DOCUMENTS

JP 2019-065411 A 4/2019

*Primary Examiner* — Jose A Fortuna
(74) *Attorney, Agent, or Firm* — Global IP Counselors, LLP

(57) ABSTRACT

A fibrous body manufacturing method includes: a first supplying step of supplying a first raw material containing a first fiber group; a second supplying step of supplying a second raw material containing a second fiber group and a binder, the second fiber group having a length-average fiber length not less than a length-average fiber length of the first fiber group, the binder being configured to bond fibers together; a forming step of forming a first deposited material by depositing a first mixed material containing the first raw material and the second raw material; and a bonding step of bonding first fibers of the first fiber group and second fibers of the second fiber group that are contained in the first deposited material together using the binder to form a first fibrous body.

11 Claims, 9 Drawing Sheets

(56) References Cited

U.S. PATENT DOCUMENTS

| | | | | |
|---|---|---|---|---|
| 6,479,061 | B2 * | 11/2002 | Fontenot | B32B 5/08 428/221 |
| 7,585,390 | B2 * | 9/2009 | Nunn | D04H 1/732 162/146 |
| 8,569,570 | B2 * | 10/2013 | Tamburro | A61F 13/51 427/2.31 |
| 9,045,857 | B2 * | 6/2015 | Gomi | D21B 1/068 |
| 9,045,858 | B2 * | 6/2015 | Gomi | D21D 5/24 |
| 9,580,848 | B2 * | 2/2017 | Henderson | D04H 1/49 |
| 9,868,854 | B2 * | 1/2018 | Ueno | B05D 3/007 |
| 10,253,456 | B2 * | 4/2019 | Seki | D21F 9/02 |
| 10,350,784 | B2 * | 7/2019 | Murayama | D21F 9/00 |
| 11,174,594 | B2 * | 11/2021 | Gomi | D21B 1/063 |
| 11,319,668 | B2 * | 5/2022 | Gomi | D21F 1/00 |
| 11,518,062 | B2 * | 12/2022 | Ueno | B27N 1/0227 |
| 2002/0068081 | A1 * | 6/2002 | Fontenot | B32B 5/26 424/443 |
| 2006/0191655 | A1 * | 8/2006 | Nunn | D04H 1/732 162/146 |
| 2007/0044891 | A1 * | 3/2007 | Sellars | D04H 1/732 264/282 |
| 2012/0296302 | A1 * | 11/2012 | Tamburro | D04H 1/645 162/146 |
| 2016/0068681 | A1 * | 3/2016 | Ueno | C08L 91/06 524/277 |
| 2018/0326699 | A1 * | 11/2018 | Knowlson | D04H 1/425 |
| 2019/0100877 | A1 | 4/2019 | Oguchi | |
| 2019/0242055 | A1 * | 8/2019 | Salam | D04H 1/52 |
| 2021/0054548 | A1 * | 2/2021 | Salam | A61K 8/0208 |
| 2022/0056642 | A1 * | 2/2022 | Nakazawa | D21H 11/14 |
| 2022/0097262 | A1 * | 3/2022 | Nakai | D04H 1/732 |
| 2022/0106739 | A1 * | 4/2022 | Yoshioka | D21H 17/36 |
| 2022/0412012 | A1 * | 12/2022 | Nakamura | D21F 9/00 |

* cited by examiner

FIG. 3

| | | FIRST EXAMPLE | SECOND EXAMPLE | THIRD EXAMPLE | FOURTH EXAMPLE | FIFTH EXAMPLE | SIXTH EXAMPLE | FIRST COMPARATIVE EXAMPLE |
|---|---|---|---|---|---|---|---|---|
| FIRST RAW MATERIAL | LENGTH-AVERAGE FIBER LENGTH LL [μm] | 800 | 800 | 800 | 800 | 800 | 800 | 800 |
| | NUMBER-AVERAGE FIBER LENGTH LN [μm] | 560 | 560 | 560 | 560 | 560 | 560 | 560 |
| | SPECIFIC TENSILE STRENGTH I [N·m/g] | 21.7 | 21.7 | 21.7 | 21.7 | 21.7 | 21.7 | 21.7 |
| SECOND RAW MATERIAL | LENGTH-AVERAGE FIBER LENGTH LL [μm] | 1000 | 1200 | 1500 | 1500 | 800 | 800 | 700 |
| | NUMBER-AVERAGE FIBER LENGTH LN [μm] | 700 | 840 | 1050 | 780 | 560 | 560 | 490 |
| | MASS RATIO OF BINDER [%] | 30 | 30 | 30 | 30 | 30 | 50 | 30 |
| AMOUNT OF SECOND RAW MATERIAL SUPPLIED | MASS RATIO RELATIVE TO FIRST RAW MATERIAL [%] | 20 | 15 | 7 | 7 | 20 | 20 | 50 |
| FIRST FIBROUS BODY | SPECIFIC TENSILE STRENGTH I [N·m/g] | 23.4 | 25.6 | 24.0 | 22.0 | 22.0 | 22.5 | 16.6 |
| EVALUATION RESULTS | | A | A | A | B | B | B | C |

FIG. 6

| | | SEVENTH EXAMPLE | SECOND COMPARATIVE EXAMPLE |
|---|---|---|---|
| THIRD RAW MATERIAL | LENGTH-AVERAGE FIBER LENGTH LL [μm] | 780 | 780 |
| | NUMBER-AVERAGE FIBER LENGTH LN [μm] | 545 | 545 |
| | MASS RATIO OF BINDER [%] | 6 | 6 |
| | SPECIFIC TENSILE STRENGTH I [N·m/g] | 23.4 | 23.4 |
| FOURTH RAW MATERIAL | LENGTH-AVERAGE FIBER LENGTH LL [μm] | 1000 | 780 |
| | NUMBER-AVERAGE FIBER LENGTH LN [μm] | 700 | 545 |
| | MASS RATIO OF BINDER [%] | 30 | 6 |
| AMOUNT OF FOURTH RAW MATERIAL SUPPLIED | MASS RATIO RELATIVE TO THIRD RAW MATERIAL [%] | 20 | 20 |
| SECOND FIBROUS BODY | SPECIFIC TENSILE STRENGTH I [N·m/g] | 24.6 | 9.5 |
| EVALUATION RESULTS | | A | C |

FIG. 9

| | | EIGHTH EXAMPLE |
|---|---|---|
| FIRST RAW MATERIAL | LENGTH-AVERAGE FIBER LENGTH LL [μm] | 800 |
| | NUMBER-AVERAGE FIBER LENGTH LN [μm] | 560 |
| | SPECIFIC TENSILE STRENGTH I [N·m/g] | 21.7 |
| SECOND RAW MATERIAL | LENGTH-AVERAGE FIBER LENGTH LL [μm] | 1000 |
| | NUMBER-AVERAGE FIBER LENGTH LN [μm] | 700 |
| AMOUNT OF SECOND RAW MATERIAL SUPPLIED | MASS RATIO RELATIVE TO FIRST RAW MATERIAL [%] | 20 |
| AMOUNT OF BINDER SUPPLIED | MASS RATIO RELATIVE TO FIRST RAW MATERIAL + SECOND RAW MATERIAL [%] | 6 |
| FIRST FIBROUS BODY | SPECIFIC TENSILE STRENGTH I [N·m/g] | 23.2 |
| EVALUATION RESULT | | A |

FIBROUS BODY MANUFACTURING METHOD AND FIBROUS BODY MANUFACTURING APPARATUS

The present application is based on, and claims priority from JP Application Serial Number 2020-139191, filed Aug. 20, 2020, the disclosure of which is hereby incorporated by reference herein in its entirety.

BACKGROUND

1. Technical Field

The present disclosure relates to a fibrous body manufacturing method and a fibrous body manufacturing apparatus.

2. Related Art

In related art, a fibrous body manufacturing apparatus that manufactures recycled paper using used waste paper as a raw material has been known. For example, JP-A-2019-065411 discloses a sheet manufacturing apparatus as a kind of a fibrous body manufacturing apparatus that controls the operation of a first material supplying unit that supplies a first material containing first fibers and the operation of a second material supplying unit that supplies a second material containing second fibers shorter than the first fibers, thereby easily adjusting the stiffness of recycled paper to be manufactured.

However, the fiber length of the fibrous body manufactured as recycled paper by the fibrous body manufacturing apparatus disclosed in JP-A-2019-065411 is less than the fiber length of the first raw material, that is, waste paper. That is, in related art, there is a possibility that a significant decrease in specific tensile strength of recycled paper will occur as a result of manufacturing the recycled paper using, as raw materials, waste paper and recycled paper whose length-average fiber length is less than the length-average fiber length of the waste paper.

SUMMARY

A fibrous body manufacturing method according to a certain aspect of the present disclosure includes: a first supplying step of supplying a first raw material containing a first fiber group; a second supplying step of supplying a second raw material containing a second fiber group and a binder, the second fiber group having a length-average fiber length not less than a length-average fiber length of the first fiber group, the binder being configured to bond fibers together; a forming step of forming a first deposited material by depositing a first mixed material containing the first raw material and the second raw material; and a bonding step of bonding first fibers of the first fiber group and second fibers of the second fiber group that are contained in the first deposited material together using the binder to form a first fibrous body.

A fibrous body manufacturing method according to another aspect of the present disclosure includes: a first supplying step of supplying a first raw material containing a first fiber group; a second supplying step of supplying a second raw material containing a second fiber group and a binder, the binder being configured to bond fibers together; a defibrating step of defibrating the first raw material; a forming step of forming a first deposited material by depositing a first mixed material containing the first raw material defibrated in the defibrating step and the second raw material; and a bonding step of bonding first fibers of the first fiber group and second fibers of the second fiber group that are contained in the first deposited material together using the binder to form a first fibrous body, wherein a specific tensile strength of the first fibrous body is not less than a specific tensile strength of the first raw material.

A fibrous body manufacturing method according to another aspect of the present disclosure includes: a first supplying step of supplying a first raw material containing a first fiber group; a second supplying step of supplying a second raw material containing a second fiber group having a length-average fiber length not less than a length-average fiber length of the first fiber group; and a binding step of bonding first fibers of the first fiber group and second fibers of the second fiber group together using a binder to form a first fibrous body, the binder being configured to bond fibers together; wherein in the first fibrous body, the second raw material is less than the first raw material in terms of a mass ratio.

A fibrous body manufacturing method according to another aspect of the present disclosure is a method for manufacturing a second fibrous body using the first fibrous body described above, including: a third supplying step of supplying, as a third raw material, the first fibrous body containing a third fiber group; a fourth supplying step of supplying a fourth raw material containing a fourth fiber group and a binder whose mass ratio is greater than a mass ratio of the binder contained in the first fibrous body; a defibrating step of defibrating the third raw material; a forming step of forming a second deposited material by depositing a second mixed material containing the first fibrous body defibrated in the defibrating step and the fourth raw material; and a bonding step of bonding third fibers of the third fiber group and fourth fibers of the fourth fiber group that are contained in the second deposited material together using the binder contained in the first fibrous body and the fourth raw material to form a second fibrous body, wherein a specific tensile strength of the second fibrous body is not less than a specific tensile strength of the first fibrous body.

A fibrous body manufacturing apparatus according to a certain aspect of the present disclosure includes: a first supplying unit that supplies a first raw material containing a first fiber group; a second supplying unit that supplies a second raw material containing a second fiber group and a binder, the second fiber group having a length-average fiber length not less than a length-average fiber length of the first fiber group, the binder being configured to bond fibers together; a forming unit that forms a first deposited material by depositing a first mixed material containing the first raw material and the second raw material; and a bonding unit that bonds first fibers of the first fiber group and second fibers of the second fiber group that are contained in the first deposited material together using the binder to form a first fibrous body.

BRIEF DESCRIPTION OF THE DRAWINGS

FIG. 3 is a table for explaining first to sixth examples and a first comparative example.

FIG. 6 is a table for explaining a seventh example and a second comparative example.

FIG. 9 is a table for explaining an eighth example.

DESCRIPTION OF EXEMPLARY EMBODIMENTS

1. First Embodiment

1-1. Configuration of Fibrous Body Manufacturing Apparatus, and Fibrous Body Manufacturing Method A schematic configuration of a fibrous body manufacturing apparatus 100 according to a first embodiment will now be explained. The fibrous body manufacturing apparatus 100 manufactures a new fibrous body, specifically, recycled paper, for example, by defibrating used waste paper that is a raw material by dry defibration to fiberize the raw material, and by pressing and heating the fiberized material after the dry defibration and then cutting the pressed-and-heated material.

Figure 1:
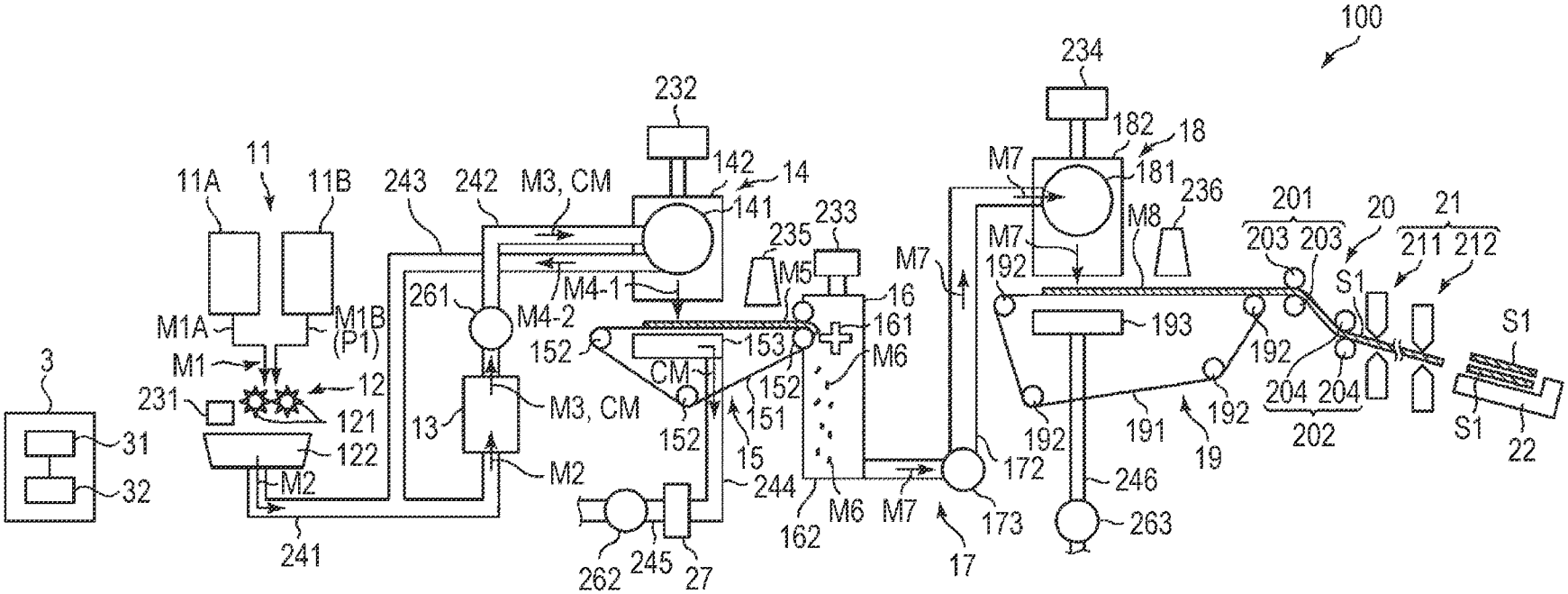
FIG. 1 illustrates a schematic configuration of a fibrous body manufacturing apparatus according to a first embodiment.

The fibrous body manufacturing apparatus 100 illustrated in FIG. 1 includes a raw material supplying unit 11, a coarse crushing unit 12, a defibrating unit 13, a screening unit 14, a first web forming unit 15, a fragmenting unit 16, a mixing unit 17, a disentangling unit 18, a second web forming unit 19 that is an example of a forming unit, a sheet forming unit 20, a cutting unit 21, and a stock unit 22. The fibrous body manufacturing apparatus 100 further includes humidifying units 231 to 236 and a control unit 3. The operation of each component of the fibrous body manufacturing apparatus 100 is controlled by the control unit 3. In the fibrous body manufacturing apparatus 100 according to the present embodiment, the side where the raw material supplying unit 11 is located is defined as "upstream", and the side where the stock unit 22 is located is defined as "downstream".

The control unit 3 performs a fibrous body manufacturing method by controlling the operation of each component of the fibrous body manufacturing apparatus 100. The control unit 3 includes a CPU (Central Processing Unit) 31 and a storage device 32. The CPU 31 is able to run various programs stored in the storage device 32. For example, the CPU 31 is able to perform various kinds of determination and give various kinds of instructions.

The control unit 3 may be built in the fibrous body manufacturing apparatus 100, or may be provided in an external device such as an external computer. The external device may, for example, communicate with the fibrous body manufacturing apparatus 100 via a cable, etc. or wirelessly. The external device may be connected to the fibrous body manufacturing apparatus 100 via a network such as, for example, the Internet. The CPU 31 and the storage device 32 may be, for example, integrated into a single unit. The CPU 31 may be built in the fibrous body manufacturing apparatus 100, and the storage device 32 may be provided in an external device such as an external computer. The storage device 32 may be built in the fibrous body manufacturing apparatus 100, and the CPU 31 may be provided in an external device such as an external computer.

Figure 2:
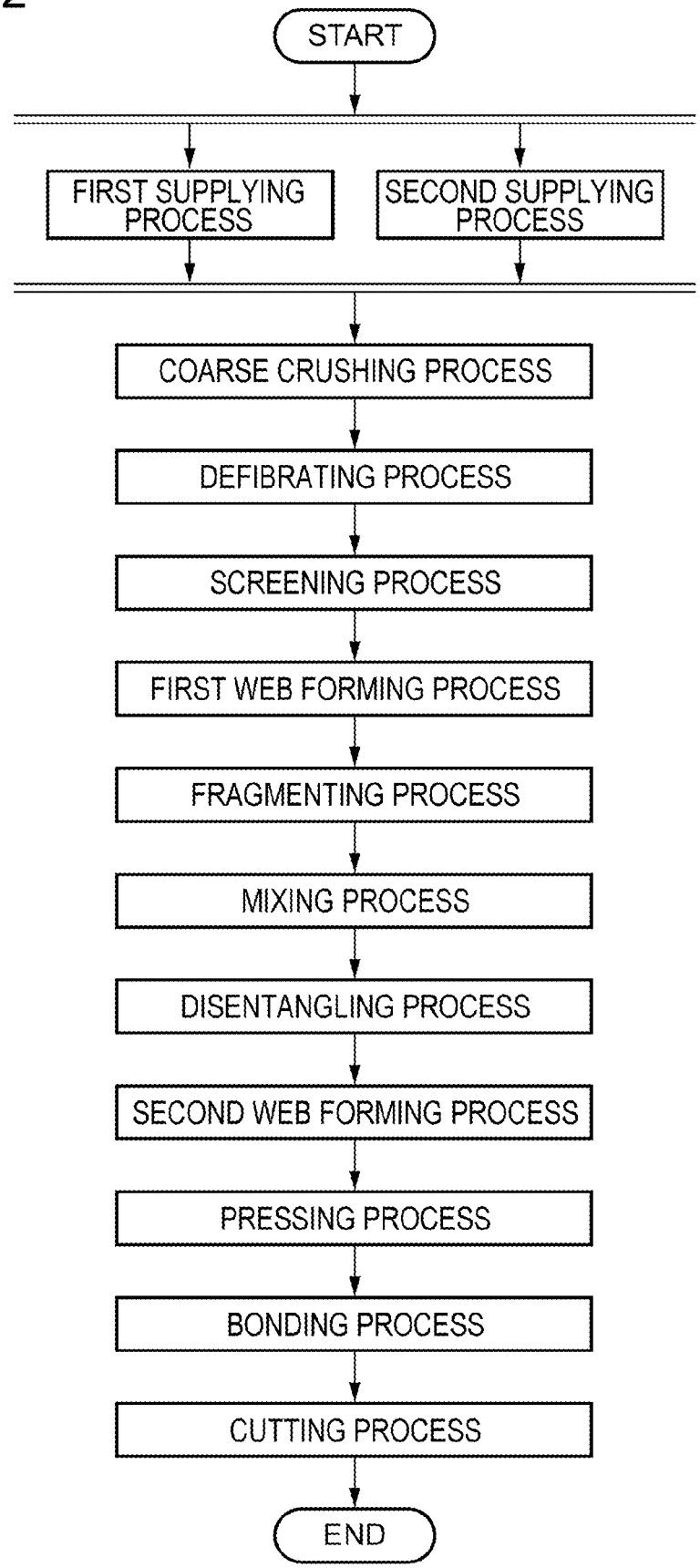
FIG. 2 is a flowchart for explaining a fibrous body manufacturing method for manufacturing recycled paper.

The fibrous body manufacturing method for manufacturing a first fibrous body S1, which is recycled paper, is performed by the fibrous body manufacturing apparatus 100 and includes a first supplying process, a second supplying process, a coarse crushing process, a defibrating process, a screening process, a first web forming process, a fragmenting process, a mixing process, a disentangling process, a second web forming process, a pressing process, a bonding process, and a cutting process as illustrated in FIG. 2.

With reference to FIGS. 1 and 2, the configuration of each component of the fibrous body manufacturing apparatus 100 will now be explained.

The raw material supplying unit 11 is a section that executes the first supplying process and the second supplying process. In the first supplying process, a first raw material M1A containing a first fiber group is supplied to the coarse crushing unit 12. In the second supplying process, a second raw material M1B containing a second fiber group is supplied to the coarse crushing unit 12. The raw material supplying unit 11 includes a first supplying unit 11A, which supplies the first raw material M1A to the coarse crushing unit 12, and a second supplying unit 11B, which supplies the second raw material M1B to the coarse crushing unit 12. In the description below, a simpler term "raw material M1" will be used when it is unnecessary to distinguish the first raw material M1A and the second raw material M1B from each other.

The raw material M1 supplied to the coarse crushing unit 12 is a fibrous material that contains fibers and has, for example, a sheet shape. Hardwood, softwood, bamboo, bagasse, banana, kenaf, cotton, palm, straw, reed, corn, mulberry, ganpi (*Diplomorpha sikokiana*), and the like can be used as the fibrous material.

In the second supplying process according to the present embodiment, the second raw material M1B containing the second fiber group and a binder P1 for bonding fibers together is supplied.

The binder P1 bonds fibers together in the bonding process, which will be executed later. For example, a thermoplastic resin, a curable resin, or the like can be used as the binder P1. It will be advantageous to use a thermoplastic resin as the binder P1. Examples of the thermoplastic resin include an AS resin, an ABS resin, polyethylene, polypropylene, polyolefin such as an ethylene-vinyl acetate copolymer (EVA), modified polyolefin, an acrylic resin such as polymethyl methacrylate, polyvinyl chloride, polystyrene, polyester such as polyethylene terephthalate and polybutylene terephthalate, polyamide (nylon) such as nylon 6, nylon 46, nylon 66, nylon 610, nylon 612, nylon 11, nylon 12, nylon 6-12, and nylon 6-66, polyphenylene ether, polyacetal, polyether, polyphenylene oxide, polyetheretherketone, polycarbonate, polyphenylene sulfide, thermoplastic polyimide, polyetherimide, a liquid crystal polymer such as aromatic polyester, various thermoplastic elastomers such as a styrene-based thermoplastic elastomer, a polyolefin-based thermoplastic elastomer, a polyvinyl chloride-based thermoplastic elastomer, a polyurethane-based thermoplastic elastomer, a polyester-based thermoplastic elastomer, a polyamide-based thermoplastic elastomer, a polybutadiene-based thermoplastic elastomer, a trans polyisoprene-based thermoplastic elastomer, a fluoro rubber-based thermoplastic elastomer, and a chlorinated polyethylene-based thermoplastic elastomer, and the like. Any one selected from among those enumerated above, or a combination of two or more, may be used. Preferably, for example, polyester or a composition containing polyester can be used as the thermoplastic resin. The binder P1 may be a dextrin made from a vegetable material such as starch or corn starch, etc.

In addition to the binder P1, the second raw material M1B may contain, for example, a colorant for coloring fibers, an aggregation inhibitor for inhibiting aggregation of fibers and aggregation of the binder P1, a flame retardant for making fibers, etc. difficult to burn, and the like.

In the present embodiment, each of the first raw material M1A and the second raw material M1B is a sheet-shaped raw material, and an example of the configuration of the fibrous body manufacturing apparatus 100 configured to supply the sheet-shaped raw material is disclosed. Each of the first supplying unit 11A and the second supplying unit 11B includes, for example, a stacker, on which a stack of sheets is to be placed, and an automatic feeder, which feeds the sheets from the stacker to the coarse crushing unit 12.

The coarse crushing unit 12 is a section that performs a coarse crushing process of coarsely crushing the first raw material M1A and the second raw material M1B supplied from the raw material supplying unit 11 under atmospheric conditions such as in air. The coarse crushing unit 12 includes a pair of coarse crushing blades 121 and a chute 122.

By rotating in respective directions that are the opposite of each other, the pair of coarse crushing blades 121 coarsely crushes, that is, shreds, the first raw material M1A and the second raw material M1B therebetween into coarse crushed pieces M2. It will be advantageous if the coarse crushed piece M2 has a shape and size suitable for defibration by the defibrating unit 13. For example, preferably, the length of a side of the small piece may be 100 mm or less. More preferably, the length of a side of the small piece may be, for example, 10 mm or more and 70 mm or less.

The chute 122 is provided under the pair of coarse crushing blades 121 and has a shape like, for example, a funnel. The chute 122 is able to receive the coarse crushed pieces M2 coarsely crushed by, and falling from, the coarse crushing blades 121.

The humidifying unit 231 is provided next to the pair of coarse crushing blades 121 over the chute 122. The humidifying unit 231 humidifies the coarse crushed pieces M2 in the chute 122. The humidifying unit 231 includes a filter containing moisture. The humidifying unit 231 is a vaporization-type humidifier that supplies humidified air with increased humidity to the coarse crushed pieces M2 by passing air through the filter. Supplying humidified air to the coarse crushed pieces M2 makes it possible to prevent the static cling of the coarse crushed pieces M2 to the chute 122 and the like.

The chute 122 is connected to the defibrating unit 13 via a pipe 241. The coarse crushed pieces M2 gathered into the chute 122 are sent to the defibrating unit 13 through the pipe 241.

The defibrating unit 13 is a section that performs a defibrating process of defibrating the first raw material M1A and the second raw material M1B after the coarse crushing by the coarse crushing unit 12. In the defibrating process, first fibers are extracted from the first fiber group contained in the first raw material M1A, and second fibers are extracted from the second fiber group contained in the second raw material M1B.

The defibrating unit 13 defibrates the coarse crushed pieces M2 containing the first fiber group and the second fiber group in air, that is, by dry defibration. It is possible to produce a defibrated material M3 from the coarse crushed pieces M2 through the defibrating process performed by the defibrating unit 13. The term "defibration" means the disentanglement of the coarse crushed pieces M2 made of plural entangled fibers into individual fibers. The result of the disentanglement is the defibrated material M3. The defibrated material M3 has a string shape or a ribbon shape. The defibrated material M3 may be in a state of so-called "lumps", in which defibrated fibers are intertwined with one another in an agglomerated manner.

The defibrating unit 13 is, for example, in the present embodiment, an impeller mill that includes a rotor that rotates at a high speed and a liner that is located in the outer circumference of the rotor. The coarse crushed pieces M2 that have flowed into the defibrating unit 13 go into the gap between the rotor and the liner and are defibrated.

By rotation of the rotor, the defibrating unit 13 is able to produce the flow of air, that is, airflow, from the coarse crushing unit 12 toward the screening unit 14. The airflow enables the defibrating unit 13 to suck the coarse crushed pieces M2 from the pipe 241. After the defibration, it is possible to send the defibrated material M3 to the screening unit 14 through a pipe 242.

In addition to the defibrating function, the defibrating unit 13 has a function of separating resin particles adhering to the defibrated material M3, ink, a colorant such as toner, and blur-preventing agent, etc. from the fibers thereof.

The defibrating unit 13 is connected to the screening unit 14 via the pipe 242. The defibrated material M3 is sent to the screening unit 14 through the pipe 242.

A blower 261 is provided between the ends of the pipe 242. The blower 261 is an airflow generator that generates airflow toward the screening unit 14. This promotes the delivery of the defibrated material M3 to the screening unit 14.

The screening unit 14 is a section that performs a screening process of screening the defibrated material M3 according to the lengths of fibers. In the screening unit 14, the defibrated material M3 is sorted into a first screened material M4-1 and a second screened material M4-2, which is larger than the first screened material M4-1. The first screened material M4-1 has a size suitable for the subsequent processes for manufacturing the first fibrous body S1. The second screened material M4-2 contains, for example, insufficiently defibrated fibers, an excessive agglomeration of defibrated fibers, and the like.

The screening unit 14 has a drum portion 141 and a housing portion 142, which houses the drum portion 141.

The drum portion 141 is a sieve that has a cylindrical net structure and rotates around its central axis. The defibrated material M3 flows into the drum portion 141. By rotation of the drum portion 141, the defibrated material M3 that is smaller than the mesh of the net is sorted as the first screened material M4-1, and the defibrated material M3 that is larger than the mesh of the net is sorted as the second screened material M4-2. The first screened material M4-1 falls from the drum portion 141.

The second screened material M4-2 is sent to a pipe 243 connected to the drum portion 141. The pipe 243 is connected to the pipe 241 at its end that is the opposite of an end connected to the drum portion 141, that is, at the downstream end. The second screened material M4-2 that has flowed through the pipe 243 merges with the coarse crushed pieces M2 inside the pipe 241 and flows together with the coarse crushed pieces M2 into the defibrating unit 13. By this means, the second screened material M4-2 is returned to the defibrating unit 13 and is subjected to defibration again together with the coarse crushed pieces M2. The first screened material M4-1 falls from the drum portion 141 while being dispersed in air and travels toward the first web forming unit 15, which is located under the drum portion 141.

The first web forming unit 15 is a section that performs a first web forming process of forming a first web M5 from the first screened material M4-1. The first web forming unit 15 includes a mesh belt 151, three stretching rollers 152, and a suction unit 153.

The mesh belt 151 is an endless belt, and the first screened material M4-1 is deposited thereon. The mesh belt 151 is stretched around the three stretching rollers 152. The first screened material M4-1 on the mesh belt 151 is transported downstream by the rotation of the stretching rollers 152.

The first screened material M4-1 has a size larger than the mesh of the mesh belt 151. Therefore, the first screened material M4-1 falling down is unable to pass through the mesh belt 151 and thus becomes deposited on the mesh belt 151. The first screened material M4-1 is transported downstream together with the mesh belt 151 while depositing on the mesh belt 151. Therefore, the first web M5 that has a layer shape is formed.

Fine particles CM such as, for example, dust or the like, colorant particles or the like, are contained in the first screened material M4-1. For example, coarse crushing or defibration sometimes produces dust or the like. Since the size of such a fine particle CM is smaller than the mesh of the mesh belt 151, the fine particle CM falls through the mesh belt 151. As a result, the first fibers, the second fibers, and the binder P1 become deposited in the form of the first web M5 on the mesh belt 151.

The suction unit 153 is a suction mechanism that sucks air from below the mesh belt 151. By this means, it is possible to suck, together with air, the fine particles CM having passed through the mesh belt 151.

The suction unit 153 is connected to a collection unit 27 via a pipe 244. The fine particles CM sucked by the suction unit 153 are collected into the collection unit 27.

A pipe 245 is connected to the collection unit 27. A blower 262 is provided between the ends of the pipe 245. By the operation of the blower 262, a suction force can be generated in the suction unit 153. This promotes the forming of the first web M5 on the mesh belt 151. The first web M5 is substantially free from the fine particles CM. The operation of the blower 262 causes the fine particles CM to flow through the pipe 244 and reach the collection unit 27.

The housing portion 142 is connected to the humidifying unit 232. The humidifying unit 232 is a vaporizing humidifier. Therefore, humidified air is supplied into the housing portion 142. The humidified air humidifies the first screened material M4-1. This prevents the static cling of the first screened material M4-1 to the inner wall of the housing portion 142.

The humidifying unit 235 is provided downstream of the screening unit 14. The humidifying unit 235 is an ultrasonic humidifier that sprays water. Ultrasonic spraying supplies moisture to the first web M5, thereby adjusting the moisture content of the first web M5. The moisture adjustment prevents the static cling of the first web M5 to the mesh belt 151. Therefore, the first web M5 comes off easily from the mesh belt 151 at a position where the mesh belt 151 is turned back by the stretching roller 152. The fragmenting unit 16 is provided downstream of the humidifying unit 235.

The fragmenting unit 16 is a section that performs a fragmenting process, in which the first web M5 that has come off from the mesh belt 151 is fragmented. The fragmenting unit 16 includes a propeller 161 that is rotatably supported and a housing portion 162 that houses the propeller 161. The first web M5 is swirled into the propeller 161 that rotates. By this means, it is possible to fragment the first web M5. The first web M5 is broken into fragments M6. The fragments M6 drop inside the housing portion 162.

The housing portion 162 is connected to the humidifying unit 233. The humidifying unit 233 is a vaporizing humidifier. Therefore, humidified air is supplied into the housing portion 162. The humidified air prevents the static cling of the fragments M6 to the propeller 161 or the inner wall of the housing portion 162.

The mixing unit 17 is provided downstream of the fragmenting unit 16. The mixing unit 17 is a section that performs a mixing process of mixing the first fibers and the second fibers that constitute the fragments M6 while performing stirring operation. The mixing unit 17 includes a pipe 172 and a blower 173.

The pipe 172 is a flow passage through which a mixture M7 of the first fibers, the second fibers, and the binder P1 in the fragments M6, mixed by stirring, flows. The pipe 172 connects the housing portion 162 of the fragmenting unit 16 to a housing portion 182 of the disentangling unit 18.

The blower 173 is provided between the ends of the pipe 172. The blower 173 is able to generate a flow of air toward the disentangling unit 18. Due to the airflow, it is possible to stir the first fibers, the second fibers, and the binder P1 inside the pipe 172. This makes it possible for the mixture M7 to flow into the disentangling unit 18 in a state in which the first fibers, the second fibers, and the binder P1 are uniformly dispersed. The fragments M6 in the mixture M7 are disentangled in the process of flowing through the pipe 172, thereby turning into a finer fibrous form.

The disentangling unit 18 is a section that performs a disentangling process of disentangling fibers intertwined with one another in the mixture M7. The disentangling unit 18 has a drum portion 181 and a housing portion 182, which houses the drum portion 181.

The drum portion 181 is a sieve that has a cylindrical net structure and rotates around its central axis. The mixture M7 flows into the drum portion 181. When the drum portion 181 rotates, fibers, etc. that are smaller than the mesh of the net, among those contained in the mixture M7, are able to pass through the drum portion 181. In this process, the mixture M7 is disentangled.

The mixture M7 disentangled in the drum portion 181 falls while being dispersed in air and travels toward the second web forming unit 19, which is located under the drum portion 181. The second web forming unit 19 is a section that performs a second web forming process, which is an example of a forming step, of forming a second web M8, which is an example of a first deposited material, from the mixture M7, which is an example of a first mixed material containing the first raw material M1A and the second raw material M1B. The second web forming unit 19 includes a mesh belt 191, stretching rollers 192, and a suction unit 193.

The mesh belt 191 is an endless belt, and the mixture M7 becomes deposited thereon. The mesh belt 191 is stretched around the four stretching rollers 192. The mixture M7 on the mesh belt 191 is transported downstream by the rotation of the stretching rollers 192.

The size of most of the mixture M7 on the mesh belt 191 is larger than the mesh of the mesh belt 191. Therefore, most of the mixture M7 is unable to pass through the mesh belt 191 and thus becomes deposited on the mesh belt 191. The mixture M7 is transported downstream together with the mesh belt 191 while depositing on the mesh belt 191. Therefore, the second web M8 that has a layer shape is formed.

The suction unit 193 is able to suck air from below the mesh belt 191. Therefore, it is possible to suck the mixture M7 onto the mesh belt 191, and the deposition of the mixture M7 on the mesh belt 191 is promoted.

A pipe 246 is connected to the suction unit 193. A blower 263 is provided between the ends of the pipe 246. By the operation of the blower 263, a suction force can be generated in the suction unit 193.

The housing portion 182 is connected to the humidifying unit 234. The humidifying unit 234 is a vaporizing humidifier, similarly to the humidifying unit 231. Therefore, humidified air is supplied into the housing portion 182. The humidified air humidifies the inside of the housing portion 182. This prevents the static cling of the mixture M7 to the inner wall of the housing portion 182.

The humidifying unit 236 is provided downstream of the disentangling unit 18. The humidifying unit 236 is an ultrasonic humidifier. Ultrasonic spraying supplies moisture to the second web M8, thereby adjusting the moisture content of the second web M8. The moisture adjustment prevents the static cling of the second web M8 to the mesh belt 191. Therefore, the second web M8 comes off easily from the mesh belt 191 at a position where the mesh belt 191 is turned back by the stretching roller 192.

The sheet forming unit 20 is provided downstream of the second web forming unit 19. The sheet forming unit 20 applies a pressing force and heat to the second web M8 so as to form the first fibrous body S1 that has a sheet shape. The sheet forming unit 20 includes a pressing portion 201 and a heating portion 202. The heating portion 202 is an example of a bonding unit. The pressing portion 201 is a section that performs a pressing process of applying a pressing force to the second web M8. The heating portion 202 is a section that performs a bonding process of bonding the first fibers of the first fiber group and the second fibers of the second fiber group that are contained in the second web M8 together by means of the binder P1 by applying heat to the second web M8, thereby forming the first fibrous body S1.

The pressing portion 201 includes a pair of calendar rollers 203 and is able to press the second web M8 between these two calendar rollers without heating. This increases the density of the second web M8. The second web M8 with increased density is transported to the heating portion 202. One of the pair of calendar rollers 203 is a drive roller that is driven by the operation of a motor. The other is a driven roller.

The heating portion 202 includes a pair of heating rollers 204. The heating roller 204 includes a heater. The heating roller 204 is heated to a preset temperature by the heater. The pair of heating rollers 204 is able to nip and press the second web M8 therebetween while applying heat. The heating and pressing causes the melting of the binder P1 in the second web M8. The molten binder P1 bonds the fibers together. As a result, the first fibrous body S1 with the first fibers and the second fibers bonded together is formed. The first fibrous body S1 is sent toward the cutting unit 21. One of the pair of heating rollers 204 is a drive roller that is driven by the operation of a motor. The other is a driven roller.

The cutting unit 21 is provided downstream of the sheet forming unit 20. The cutting unit 21 is a section that performs a cutting process of cutting the first fibrous body S1. The cutting unit 21 includes a first cutter 211 and a second cutter 212.

The first cutter 211 cuts the first fibrous body S1 in a direction that intersects with the transport direction of the first fibrous body S1.

The second cutter 212 cuts the first fibrous body S1 in a direction parallel to the transport direction of the first fibrous body S1 downstream of the first cutter 211.

The first fibrous body S1 having a sheet shape and a predetermined size can be obtained by performing cutting with the first cutter 211 and the second cutter 212 as described above. The first fibrous body S1 is further transported downstream and is then ejected onto the stock unit 22. The stock unit 22 includes a tray or a stacker on which sheets of the first fibrous body S1 having a predetermined size are to be stacked.

In the present embodiment, an example of the configuration of the fibrous body manufacturing apparatus 100 configured to supply the sheet-shaped first raw material M1A and the sheet-shaped second raw material M1B has been disclosed. However, the second raw material is not limited to such a sheet-shaped raw material. The second raw material may be a powdery fibrous material or a fiber block. If a powdery fibrous material containing the binder P1 is supplied as the second raw material, coarse crushing and defibration are unnecessary. Therefore, in this case, the first raw material M1A is coarsely crushed in the coarse crushing process, and the first raw material M1A is defibrated in the defibrating process. If the second raw material that is in powdery form is supplied, a fibrous material supplying unit configured to supply such a powdery fibrous material from a cartridge containing the powdery fibrous material is provided somewhere between the drum portion 141 and the drum portion 181.

1-2. First to Sixth Examples

Next, with reference to FIG. 3, examples of manufacturing the first fibrous body S1 by the fibrous body manufacturing apparatus 100 using the fibrous body manufacturing method according to the present embodiment, and a comparative example, will now be explained.

FIG. 3 shows, from the top in this order, the first raw material M1A supplied in the first supplying process, the second raw material M1B supplied in the second supplying process, the amount of the second raw material M1B supplied, the first fibrous body S1 formed by the fibrous body manufacturing apparatus 100, and evaluation results. The first raw material M1A is a sheet-shaped raw material containing the first fiber group, the principal ingredient of which is hardwood. The second raw material M1B is a sheet-shaped raw material containing the second fiber group, the principal ingredient of which is hardwood. The second raw material M1B contains the binder P1 for bonding fibers together.

In the column of each example and the column of the comparative example, supply conditions, including, the length-average fiber length LL [μm] of each of the first raw material M1A and the second raw material M1B supplied to the fibrous body manufacturing apparatus 100, the number-average fiber length LN [μm] thereof, the mass ratio [%] of the binder P1 contained in the second raw material M1B, and the mass ratio [%] of the second raw material M1B relative to the first raw material M1A, are shown; in addition to these supply conditions, the specific tensile strength [N·m/g] of the first raw material M1A and the specific tensile strength [N·m/g] of the first fibrous body S1 formed by the fibrous body manufacturing apparatus 100 are also shown.

Evaluation results graded on a scale of A, B, and C are shown in the bottom row of the table of the examples and the comparative example.

The length-average fiber length LL and the number-average fiber length LN are known as indices indicating fiber length. The length-average fiber length LL and the number-average fiber length LN are expressed by the following formulas (1) and (2) respectively.

$$LL = \frac{\sum ni \cdot li^2}{\sum ni \cdot li} \quad (1)$$

$$LN = \frac{\sum ni \cdot li}{\sum ni} \quad (2)$$

In the formulas (1) and (2), ni denotes the number of fibers of a fraction i, and li denotes the average length of the fibers of the fraction i, where i is a natural number.

The specific tensile strength (tensile index) of the first raw material M1A and the specific tensile strength of the first fibrous body S1 were measured in conformity with JIS P 8113: 2006 "Paper and board—Determination of tensile properties—Part 2: Constant rate of elongation method".

The evaluation results are based on IS/IA, where IA denotes the specific tensile strength I of the first raw material M1A, and IS denotes the specific tensile strength I of the first fibrous body S1.

Cases where IS/IA≥1.05, meaning that the first fibrous body S1 having the specific tensile strength IS whose value is greater than the specific tensile strength IA of the first raw material M1A by 5% or more was obtained, are rated "A" in the table.

Cases where 1.0≤IS/IA<1.05, meaning that the first fibrous body S1 having the specific tensile strength IS whose value is equal to or greater than the specific tensile strength IA of the first raw material M1A by 0% to 5% or less was obtained, are rated "B" in the table.

A case where IS/IA<1.0, meaning that the first fibrous body S1 having the specific tensile strength IS whose value is less than the specific tensile strength IA of the first raw material M1A was obtained, is rated "C" in the table.

Figure 4:
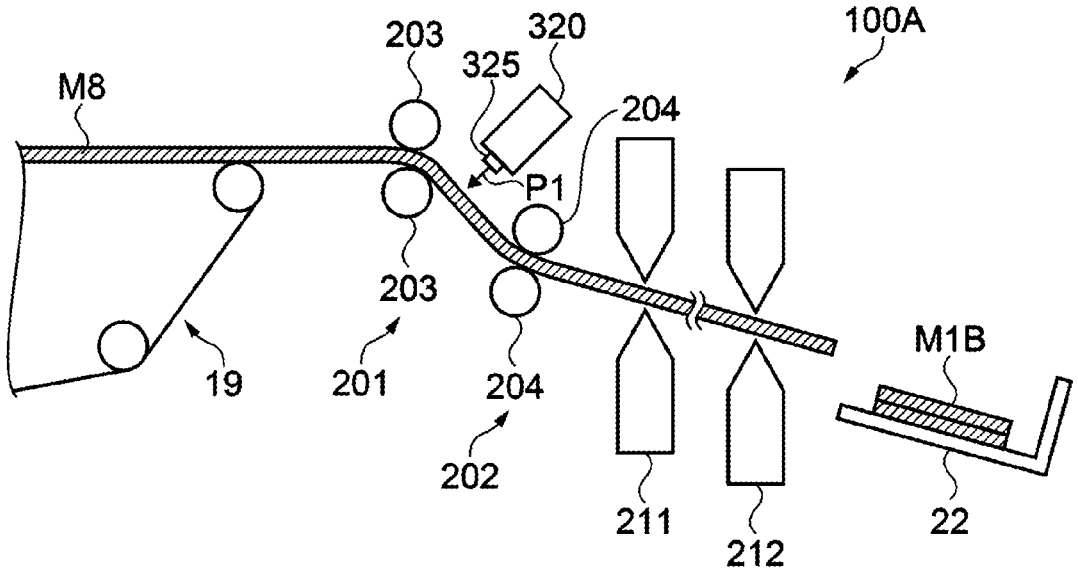
FIG. 4 illustrates a schematic configuration of a fibrous body manufacturing apparatus that manufactures a second raw material containing a binder.

The sheet-shaped second raw material M1B containing the binder P1 had been manufactured by a fibrous body manufacturing apparatus 100A illustrated in FIG. 4. In addition to the components of the fibrous body manufacturing apparatus 100 illustrated in FIG. 1, the fibrous body manufacturing apparatus 100A further includes a droplet ejecting unit 320 configured to eject the binder P1. The same reference numerals are assigned to components that are the same as those of the fibrous body manufacturing apparatus 100. An explanation of them is omitted.

As illustrated in FIG. 4, the fibrous body manufacturing apparatus 100A includes the droplet ejecting unit 320 disposed between the pair of calendar rollers 203 of the pressing portion 201 and the pair of heating rollers 204 of the heating portion 202. The droplet ejecting unit 320 includes an ejecting head 325 that has a plurality of nozzles. The ejecting head 325 faces one side of the second web M8 that is transported. The ejecting head 325 ejects liquid in the form of micro droplets from the nozzles using an ink-jet ejection method.

The droplet ejecting unit 320 includes a serial-type ejecting mechanism configured to eject liquid in the form of droplets while reciprocating the ejecting head 325 in a direction that intersects with the transport direction of the second web M8. The droplet ejecting unit 320 ejects, in the form of droplets, liquid that contains the binder P1 for bonding fibers together toward the second web M8 that has been pressed by the pressing portion 201. The ejected droplets of the liquid containing the binder P1 land onto the surface of the second web M8. After the landing of the droplets, heat is applied to the second web M8 by the heating portion 202. The second raw material M1B containing the binder P1 can be formed in this way. As another example of a method for forming the second raw material M1B containing the binder P1, the following method may be used: after the mixing of the binder P1 with the fibers contained in the second raw material M1B, the mixture is caused to deposit so as to form a deposited material; then, the deposited material is heated and pressed so as to form the second raw material M1B. Even when such an alternative method is used, it is possible to adjust the amount of the binder P1 that is present inside the second raw material M1B in accordance with an addition amount of the binder P1 that is supplied.

It is possible to obtain the second raw material M1B having a desired fiber length and a desired mass ratio of the binder P1 by supplying a fibrous material whose fiber length is controlled as the raw material M1 from the raw material supplying unit 11 and by controlling an ejection amount of the binder P1 ejected from the droplet ejecting unit 320 toward the second web M8. The fibrous material supplied as the raw material M1 may be any of a sheet-shaped fibrous material, a powdery fibrous material, and a fiber block, similarly to the fibrous body manufacturing apparatus 100.

In the examples and the comparative example, a thermoplastic resin (ACT-2201) manufactured by DIC Corporation was used as the binder P1.

In the first comparative example, the first raw material M1A having a length-average fiber length of LL=800 μm and a number-average fiber length of LN=560 μm was supplied in the first supplying process, and the second raw material M1B having a length-average fiber length of LL=700 μm, a number-average fiber length of LN=490 μm, and a mass ratio of the binder P1 of 30% was supplied in the second supplying process at a mass ratio of 50% relative to the first raw material M1A. The specific tensile strength of the first fibrous body S1 manufactured by the fibrous body manufacturing apparatus 100 using the fibrous body manufacturing method was I=16.6 N·m/g. Since the specific tensile strength of the first raw material M1A is I=21.7 N·m/g, the specific tensile strength of the first fibrous body S1 manufactured under the conditions of the first comparative example is less than the specific tensile strength of the first raw material M1A. No matter how much the amount of the second raw material M1B containing the binder P1 at the mass ratio of 30% to be added to the first raw material M1A is increased, if the length-average fiber length of the second raw material M1B is less than the length-average fiber length of the first raw material M1A, it is impossible to manufacture the first fibrous body S1 having the same degree of strength as the specific tensile strength of the first raw material M1A. This means that a significant decrease in specific tensile strength will occur if the manufacturing of recycled paper is performed repeatedly using the first fibrous body S1, which is recycled paper, as a principal raw material for recycling.

In the first to sixth examples, the same first raw material M1A as that of the first comparative example was supplied in the first supplying process.

In the first to fourth examples, the second raw material M1B having a length-average fiber length greater than the length-average fiber length of the first raw material M1A was supplied in the second supplying process.

In the first example, the first raw material M1A having a length-average fiber length of LL=800 μm and a number-average fiber length of LN=560 μm was supplied in the first supplying process, and the second raw material M1B having a length-average fiber length of LL=1,000 μm, a number-average fiber length of LN=700 μm, and a mass ratio of the binder P1 of 30% was supplied in the second supplying process at a mass ratio of 20% relative to the first raw material M1A. The specific tensile strength of the first fibrous body S1 manufactured by the fibrous body manufacturing apparatus 100 using the fibrous body manufacturing method was I=23.4 N·m/g. Adding the second raw material M1B having a length-average fiber length greater than the length-average fiber length of the first raw material M1A to the first raw material M1A, which is a principal raw material, made it possible to obtain the first fibrous body S1, that is, recycled paper, having a specific tensile strength greater than the specific tensile strength of the first raw material M1A by more than 5%.

In the second example, the first raw material M1A having a length-average fiber length of LL=800 μm and a number-average fiber length of LN=560 μm was supplied in the first supplying process, and the second raw material M1B having a length-average fiber length of LL=1,200 μm, a number-average fiber length of LN=840 μm, and a mass ratio of the binder P1 of 30% was supplied in the second supplying process at a mass ratio of 15% relative to the first raw material M1A. The specific tensile strength of the first fibrous body S1 manufactured by the fibrous body manufacturing apparatus 100 using the fibrous body manufacturing method was I=25.6 N·m/g. Adding the second raw material M1B having a length-average fiber length greater than the length-average fiber length of the second raw material of the foregoing first example to the first raw material M1A made it possible to obtain the first fibrous body S1, that is, recycled paper, having a specific tensile strength greater than the specific tensile strength of the first raw material M1A by more than 5% with a smaller amount of supply than that of the foregoing first example.

In the third example, the first raw material M1A having a length-average fiber length of LL=800 μm and a number-average fiber length of LN=560 μm was supplied in the first supplying process, and the second raw material M1B having a length-average fiber length of LL=1,500 μm, a number-average fiber length of LN=1,050 μm, and a mass ratio of the binder P1 of 30% was supplied in the second supplying process at a mass ratio of 7% relative to the first raw material M1A. The specific tensile strength of the first fibrous body S1 manufactured by the fibrous body manufacturing apparatus 100 using the fibrous body manufacturing method was I=24.0 N·m/g. Adding the second raw material M1B having a length-average fiber length greater than the length-average fiber length of the second raw material of the foregoing second example to the first raw material M1A made it possible to obtain the first fibrous body S1, that is, recycled paper, having a specific tensile strength greater than the specific tensile strength of the first raw material M1A by more than 5% with a smaller amount of supply than that of the foregoing second example.

In the fourth example, the first raw material M1A having a length-average fiber length of LL=800 μm and a number-average fiber length of LN=560 μm was supplied in the first supplying process, and the second raw material M1B having a length-average fiber length of LL=1,500 μm, a number-average fiber length of LN=780 μm, and a mass ratio of the binder P1 of 30% was supplied in the second supplying process at a mass ratio of 7% relative to the first raw material M1A. That is, in the fourth example, the second raw material M1B that is the same as the second raw material of the foregoing third example except for a shorter number-average fiber length was used. The specific tensile strength of the first fibrous body S1 manufactured by the fibrous body manufacturing apparatus 100 using the fibrous body manufacturing method was I=22.0 N·m/g. Adding the second raw material M1B having a number-average fiber length less than the number-average fiber length of the second raw material of the foregoing third example to the first raw material M1A made it possible to obtain the first fibrous body S1 having a specific tensile strength greater than the specific tensile strength of the first raw material M1A, although the specific tensile strength of the first fibrous body S1 obtained from the fourth example is less than the specific tensile strength of the first fibrous body S1 obtained from the foregoing third example. In other words, the second raw material M1B having a greater number-average fiber length produces an effect of increasing the specific tensile strength of the first fibrous body S1.

In the fifth example, the first raw material M1A having a length-average fiber length of LL=800 μm and a number-average fiber length of LN=560 μm was supplied in the first supplying process, and the second raw material M1B having a length-average fiber length of LL=800 μm, a number-average fiber length of LN=560 μm, and a mass ratio of the binder P1 of 30% was supplied in the second supplying process at a mass ratio of 20% relative to the first raw material M1A. That is, in the fifth example, a raw material obtained by impregnating the first raw material M1A with the binder P1 at a mass ratio of 30% was used as the second raw material M1B. The specific tensile strength of the first fibrous body S1 manufactured by the fibrous body manufacturing apparatus 100 using the fibrous body manufacturing method was I=22.0 N·m/g. Despite the fact that the second raw material M1B has the same fiber length as the fiber length of the first raw material M1A, the presence of the binder P1 for bonding fibers together made it possible to obtain the first fibrous body S1 having a specific tensile strength greater than the specific tensile strength of the first raw material M1A.

In the sixth example, the first raw material M1A having a length-average fiber length of LL=800 μm and a number-average fiber length of LN=560 μm was supplied in the first supplying process, and the second raw material M1B having a length-average fiber length of LL=800 μm, a number-average fiber length of LN=560 μm, and a mass ratio of the binder P1 of 50% was supplied in the second supplying process at a mass ratio of 20% relative to the first raw material M1A. That is, in the sixth example, the second raw material M1B containing the binder P1 at a greater mass ratio than that of the fifth example was used. The specific tensile strength of the first fibrous body S1 manufactured by the fibrous body manufacturing apparatus 100 using the fibrous body manufacturing method was I=22.5 N·m/g. The increased content of the binder P1 made it possible to obtain the first fibrous body S1 having a specific tensile strength greater than the specific tensile strength of the first fibrous body S1 obtained from the foregoing fifth example.

As can be seen from the results of the first to sixth examples, adding, as the second raw material M1B, a raw material having a length-average fiber length not less than the length-average fiber length of the first raw material M1A, which is a principal raw material, to the first raw material M1A made it possible to obtain the first fibrous body S1 having a specific tensile strength greater than the specific tensile strength of the first raw material M1A. That is, the weakening of the specific tensile strength of the first fibrous body S1 is suppressed. Moreover, it is possible to obtain the first fibrous body S1 as recycled paper having a specific tensile strength greater than the specific tensile strength of the first raw material M1A as waste paper.

As can be seen from the results of the first to third examples, adding, as the second raw material M1B, a raw material having a greater length-average fiber length made it possible to reduce the supply amount of the second raw material M1B added to the first raw material M1A, which is a principal raw material.

As can be seen from the results of the third to fifth examples, the number-average fiber length of the second raw material M1B is preferably not less than the number-average fiber length of the first raw material M1A. Adding, as the second raw material M1B, a raw material having a number-average fiber length not less than the number-average fiber length of the first raw material M1A, which is a principal raw material, to the first raw material M1A made it possible to obtain the first fibrous body S1 having a specific tensile strength greater than the specific tensile strength of the first raw material M1A. As can be seen from the results of the third and fourth examples, further increasing the length-average fiber length of the second raw material M1B to be added made it possible to further enhance the specific tensile strength of the first fibrous body S1 to be obtained.

As can be seen from the results of the fifth and sixth examples, the mass ratio of the binder P1 contained in the second raw material M1B is preferably 30% or more. Even when the fiber length of the second raw material M1B is the same as the fiber length of the first raw material M1A, adding the second raw material M1B containing the binder P1 at a mass ratio of 30% or more made it possible to obtain the first fibrous body S1, which is recycled paper, without losing the specific tensile strength of the first raw material M1A, which is waste paper. Moreover, it is possible to improve the specific tensile strength of the first fibrous body S1 by increasing the amount of the binder P1 contained in the second raw material M1B.

The first raw material M1A may contain a binder P1. For example, sheet-shaped fibers manufactured by a dry-type fibrous body manufacturing apparatus contain a binder P1 for bonding fibers together. In this case, the mass ratio of the binder P1 contained in the second raw material M1B relative to the second raw material M1B is preferably greater than the mass ratio of the binder P1 contained in the first raw material M1A relative to the first raw material M1A. This makes it possible to further improve the specific tensile strength of the first fibrous body S1.

1-3. Repeat Cycle for Production of Recycled Paper from Recycled Paper

Figure 5:
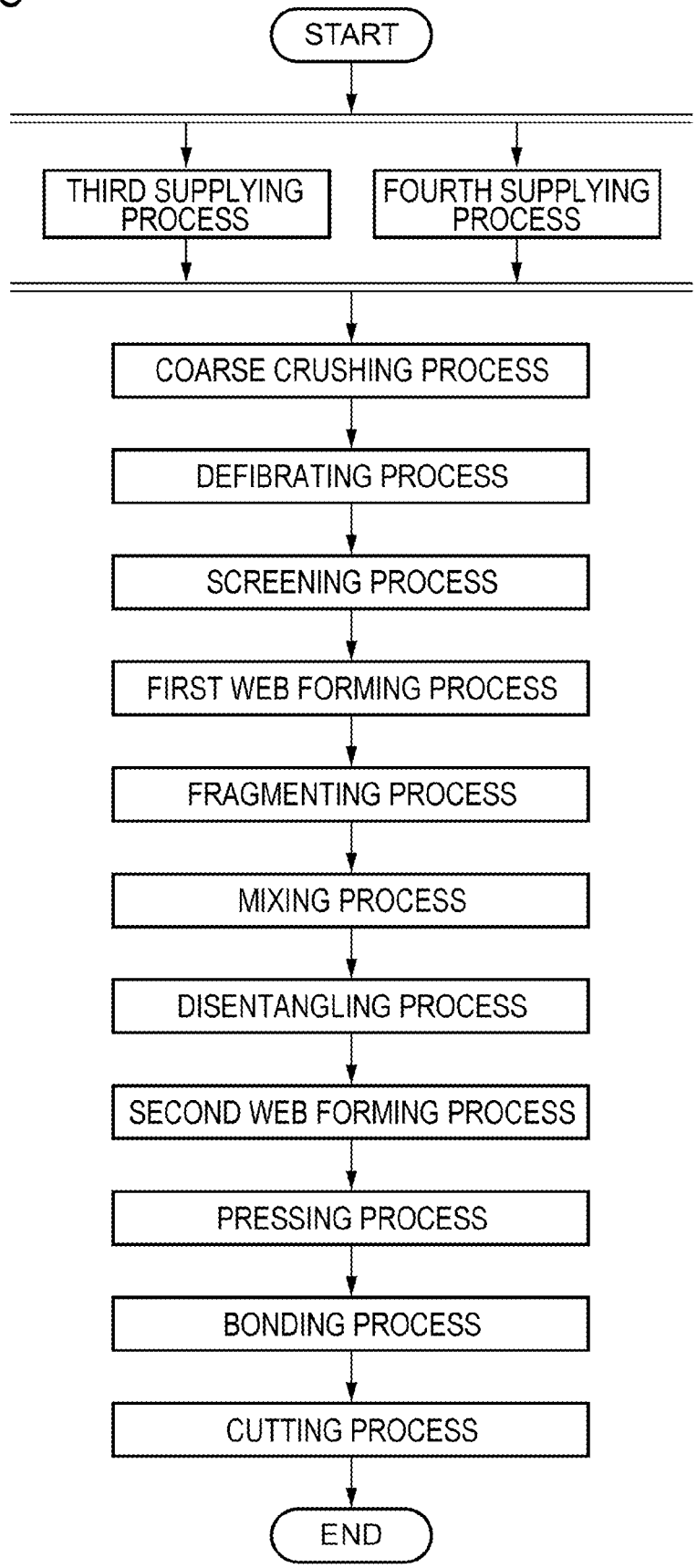
FIG. 5 is a flowchart for explaining a fibrous body manufacturing method for manufacturing recycled-again-after-recycle paper.

FIG. 5 is a flowchart that illustrates a fibrous body manufacturing method for manufacturing a second fibrous body that is "recycled-again-after-recycle" paper produced using a first fibrous body S1 that is recycled paper manufactured through the processes of the fibrous body manufacturing method illustrated in FIG. 2. The apparatus used for manufacturing the second fibrous body is the same as the fibrous body manufacturing apparatus 100 used for manufacturing the first fibrous body S1. The second fibrous body is manufactured from a third raw material that is the first fibrous body S1 supplied to the first supplying unit 11A and from a fourth raw material supplied to the second supplying unit 11B.

The first fibrous body S1 containing a third fiber group is supplied in a third supplying process. In a fourth supplying process, the fourth raw material, which contains a fourth fiber group and a binder P1 at a greater mass ratio in comparison with a binder P1 contained in the first fibrous body S1, is supplied. The third supplying process and the fourth supplying process are executed by the raw material supplying unit 11.

In a coarse crushing process, the first fibrous body S1 and the fourth raw material are coarsely crushed in air. In a defibrating process, the first fibrous body S1 and the fourth raw material are defibrated in air. The coarse crushing process is executed by the coarse crushing unit 12. In the defibrating process, third fibers are extracted from the third fiber group contained in the first fibrous body S1, and fourth fibers are extracted from the fourth fiber group contained in the fourth raw material. The defibrating process is executed by the defibrating unit 13. If a powdery fibrous material containing the binder P1 is supplied as the fourth raw material, coarse crushing and defibration are unnecessary. Therefore, in this case, the first fibrous body S1 is coarsely crushed in the coarse crushing process, and the first fibrous body S1 is defibrated in the defibrating process.

Steps from the screening process to the disentangling process, the pressing process, and the cutting process are the same as those of the flow for manufacturing the first fibrous body S1. Therefore, these same steps are not explained here.

In a second web forming process as an example of a forming step, a second web M8 as an example of a second deposited material is formed by depositing a mixture M7, as an example of a second mixed material, containing the first fibrous body S1 and the fourth raw material that have been defibrated in the defibrating process. The forming process is executed by the second web forming unit 19.

In a bonding process, the third fibers of the third fiber group and the fourth fibers of the fourth fiber group that are contained in the second web M8 are bonded together by means of the binder P1 contained in the first fibrous body S1 and the fourth raw material, thereby forming the second fibrous body. The bonding process is executed by the heating portion 202.

1-4. Seventh Example

Next, with reference to FIG. 6, an example of manufacturing the second fibrous body that is recycled-again-after-recycle paper by the fibrous body manufacturing apparatus 100 using the fibrous body manufacturing method according to the present embodiment will now be explained.

FIG. 6 shows, from the top in this order, the first fibrous body S1 supplied in the third supplying process, the fourth raw material supplied in the fourth supplying process, the amount of the fourth raw material supplied, the second fibrous body formed by the fibrous body manufacturing apparatus 100, and evaluation results. The first fibrous body S1 is a sheet-shaped raw material containing the third fiber group, the principal ingredient of which is hardwood. The fourth raw material is a sheet-shaped raw material containing the fourth fiber group, the principal ingredient of which is hardwood. Each of the first fibrous body S1 and the fourth raw material contains the binder P1 for bonding fibers together.

In the column of the example and the column of the comparative example, supply conditions, including, the length-average fiber length LL [μm] of each of the first fibrous body S1 and the fourth raw material supplied to the fibrous body manufacturing apparatus 100, the number-average fiber length LN [μm] thereof, the mass ratio [%] of the binder P1 contained in the first fibrous body S1, the mass ratio [%] of the binder P1 contained in the fourth raw material, and the mass ratio [%] of the fourth raw material relative to the first fibrous body S1, are shown; in addition to these supply conditions, the specific tensile strength [N·m/g] of the first fibrous body S1 and the specific tensile strength [N·m/g] of the second fibrous body formed by the fibrous body manufacturing apparatus 100 are also shown. Evaluation results graded on a scale of A, B, and C are shown in the bottom row of the table of the example and the comparative example.

In the second comparative example, the first fibrous body S1 manufactured according to the foregoing first example was supplied as both the third raw material and the fourth raw material. The first fibrous body S1 has a length-average fiber length of LL=780 μm, a number-average fiber length of LN=545 μm, and a mass ratio of the binder P1 of 6%. The specific tensile strength of the second fibrous body manufactured by the fibrous body manufacturing apparatus 100 using the fibrous body manufacturing method was I=9.5 N·m/g. Since the specific tensile strength of the first fibrous body S1 is I=23.4 N·m/g, the specific tensile strength of the second fibrous body, recycled-again-after-recycle paper, manufactured under the conditions of the second comparative example is significantly less than the specific tensile strength of the first fibrous body S1, recycled paper.

In the seventh example, the first fibrous body S1 was supplied as the third raw material, and the fourth raw material having a length-average fiber length greater than the length-average fiber length of the first fibrous body S1 and containing the binder P1 at a greater mass ratio in comparison with the binder P1 contained in the first fibrous body S1 was supplied. The values of the fourth raw material are the same as those of the second raw material M1B used in the foregoing first example.

In the seventh example, the first fibrous body S1 having a length-average fiber length of LL=780 μm, a number-average fiber length of LN=545 μm, and a mass ratio of the binder P1 of 6% was supplied in the third supplying process, and the fourth raw material having a length-average fiber length of LL=1,000 μm, a number-average fiber length of LN=700 μm, and a mass ratio of the binder P1 of 30% was supplied in the fourth supplying process at a mass ratio of 20% relative to the first fibrous body S1. The specific tensile strength of the second fibrous body manufactured by the fibrous body manufacturing apparatus 100 using the fibrous body manufacturing method was I=24.6 N·m/g. Since the specific tensile strength of the first fibrous body S1 is I=23.4 N·m/g, adding the fourth raw material having a length-average fiber length greater than the length-average fiber length of the first fibrous body S1 and containing the binder P1 at a greater mass ratio in comparison with the binder P1 contained in the first fibrous body S1 to the first fibrous body S1, which is a principal raw material, made it possible to obtain the second fibrous body having a specific tensile strength greater than the specific tensile strength of the first fibrous body S1.

The second fibrous body is recycled-again-after-recycle paper manufactured through repeated recycling that involves using, as a principal raw material, the first fibrous body S1 that is recycled paper manufactured by adding the second raw material M1B containing the binder P1 for bonding fibers together to the first raw material M1A that is waste paper, and adding the fourth raw material thereto. That is, it is possible to manufacture recycled paper having a specific tensile strength greater than the specific tensile strength of the first raw material M1A repeatedly.

In the foregoing examples, the first raw material M1A is a fibrous material the principal ingredient of which is hardwood, and the second raw material M1B is also a fibrous material the principal ingredient of which is hardwood. However, the first raw material M1A and the second raw material M1B may be different fibrous materials.

As explained above, the following effects can be obtained from the fibrous body manufacturing apparatus 100 and the fibrous body manufacturing method according to the first embodiment.

A fibrous body manufacturing method includes: a first supplying process of supplying the first raw material M1A containing a first fiber group; a second supplying process of supplying the second raw material M1B containing a second fiber group and the binder P1, the second fiber group having a length-average fiber length not less than a length-average fiber length of the first fiber group; a second web forming process of forming the second web M8, which is an example of a first deposited material; and a bonding process of forming a first fibrous body with the bonding of first fibers and second fibers. With these processes, it is possible to provide a fibrous body manufacturing method that makes it possible to suppress the weakening of the specific tensile strength of the first fibrous body S1 in comparison with the first raw material M1A.

A fibrous body manufacturing method includes: a first supplying process of supplying the first raw material M1A containing a first fiber group; a second supplying process of supplying the second raw material M1B containing a second fiber group and the binder P1; a defibrating process of defibrating the first raw material M1A; a second web forming process of forming the second web M8; and a bonding process of forming a first fibrous body with the bonding of first fibers and second fibers using the binder P1. With these processes, it is possible to provide a fibrous body manufacturing method that makes it possible to suppress the weakening of the specific tensile strength of the first fibrous body S1 and manufacture the first fibrous body S1 having the specific tensile strength not less than the specific tensile strength of the first raw material M1A.

In the fibrous body manufacturing method, the second raw material M1B containing the second fiber group having the length-average fiber length not less than the length-average fiber length of the first fiber group is supplied in the second supplying process. Therefore, it is possible to manufacture the first fibrous body S1 having a further enhanced specific tensile strength.

In the fibrous body manufacturing method, the second raw material M1B containing the second fiber group having the length-average fiber length greater than the length-average fiber length of the first fiber group is supplied in the second supplying process. Therefore, it is possible to manufacture the first fibrous body S1 having a further enhanced specific tensile strength.

In the fibrous body manufacturing method, when the first raw material M1A contains the binder P1, the mass ratio of the binder P1 relative to the second raw material M1B is greater than the mass ratio of the binder P1 contained in the first raw material M1A relative to the first raw material M1A. Therefore, it is possible to manufacture the first fibrous body S1 having a further enhanced specific tensile strength.

Since the fibrous body manufacturing method further includes a defibrating process of defibrating the first raw material M1A, it is possible to extract first fibers from the first raw material M1A well.

Since the fibrous body manufacturing method further includes a defibrating process of defibrating the first raw material M1A and the second raw material M1B, it is possible to extract first fibers from the first raw material M1A and extract second fibers from the second raw material M1B well.

In the defibrating process of the fibrous body manufacturing method, the first raw material M1A and the second raw material M1B are defibrated. Therefore, it is possible to extract first fibers from the first raw material M1A and extract second fibers from the second raw material M1B well.

The fibrous body manufacturing method further includes a coarse crushing process of coarsely crushing the first raw material M1A, or the first raw material M1A and the second raw material M1B. Therefore, it is possible to supply the first raw material M1A having a sheet shape, or the first raw material M1A and the second raw material M1B having a sheet shape.

A fibrous body manufacturing method includes: a third supplying process of supplying the first fibrous body S1 containing a third fiber group; a fourth supplying process of supplying a fourth raw material containing a fourth fiber group and the binder P1 whose mass ratio is greater than a mass ratio of the binder P1 contained in the first fibrous body S1; a second web forming process of forming the second web M8, which is an example of a second deposited material; and a bonding process of forming a second fibrous body with the bonding of third fibers and fourth fibers. With these processes, it is possible to provide a fibrous body manufacturing method that makes it possible to suppress the weakening of the specific tensile strength of the second fibrous body in comparison with the first fibrous body S1.

The fibrous body manufacturing apparatus 100 includes: the first supplying unit 11A that supplies the first raw material M1A containing a first fiber group; the second supplying unit 11B that supplies the second raw material M1B containing a second fiber group and the binder P1, the second fiber group having a length-average fiber length not less than a length-average fiber length of the first fiber group; the second web forming unit 19 that forms the second web M8; and the heating portion 202 that forms the first fibrous body S1 with the bonding of first fibers and second fibers. With these units, it is possible to provide the fibrous body manufacturing apparatus 100 that makes it possible to suppress the weakening of the specific tensile strength of the first fibrous body in comparison with the first raw material M1A.

2. Second Embodiment

Figure 7:
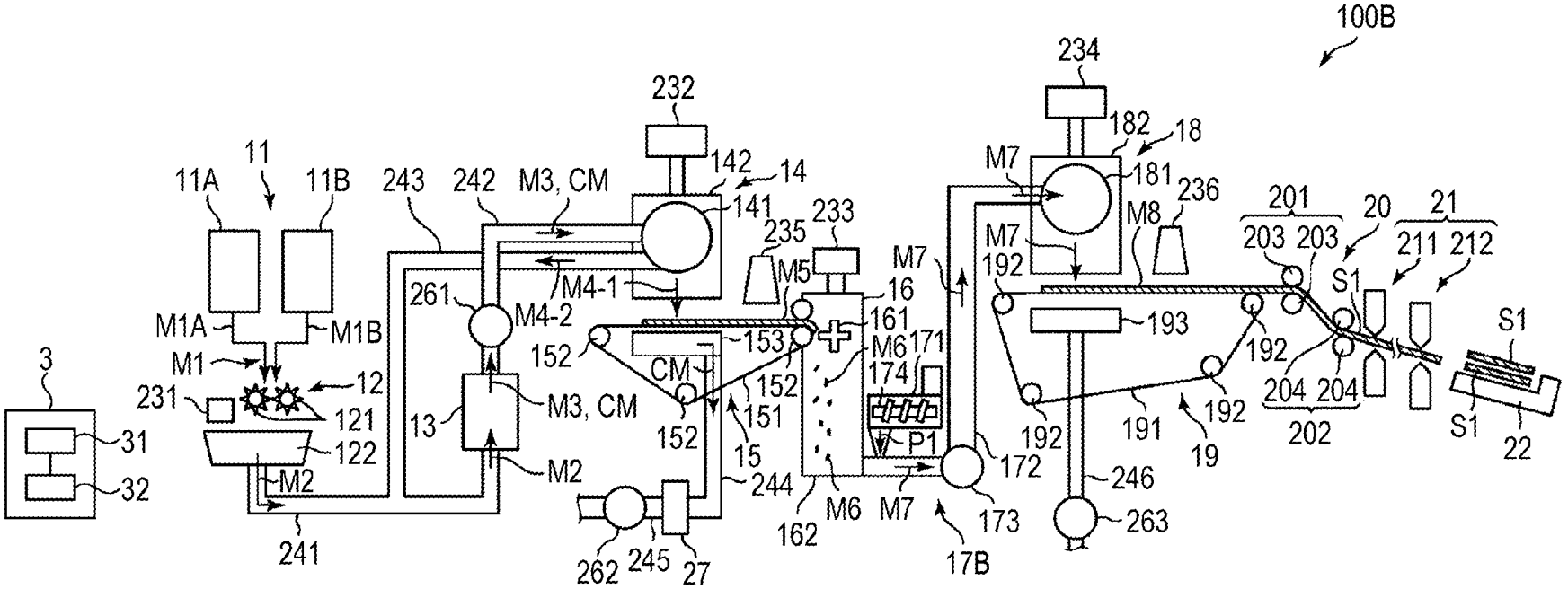
FIG. 7 illustrates a schematic configuration of a fibrous body manufacturing apparatus according to a second embodiment.

With reference to FIG. 7, a schematic configuration of a fibrous body manufacturing apparatus 100B according to a second embodiment will now be explained. In the present embodiment, each of the first raw material M1A and the second raw material M1B is a sheet-shaped raw material, and an example of the configuration of the fibrous body manufacturing apparatus 100B configured to supply the sheet-shaped raw material is disclosed. The same reference numerals are assigned to components that are the same as those of the first embodiment. An explanation of them is omitted. In the present embodiment, the second raw material M1B not containing the binder P1 is supplied. Therefore, the fibrous body manufacturing apparatus 100B includes a binder supplying unit 171 that supplies the binder P1.

The fibrous body manufacturing apparatus 100B illustrated in FIG. 7 includes the raw material supplying unit 11, the coarse crushing unit 12, the defibrating unit 13, the screening unit 14, the first web forming unit 15, the fragmenting unit 16, a mixing unit 17B, the disentangling unit 18, the second web forming unit 19, the sheet forming unit 20, the cutting unit 21, and the stock unit 22. The fibrous body manufacturing apparatus 100B further includes the humidifying units 231 to 236 and the control unit 3.

The mixing unit 17B is located downstream of the fragmenting unit 16. The mixing unit 17B includes the binder supplying unit 171, the pipe 172, and the blower 173.

The binder supplying unit 171 is connected between the ends of the pipe 172 connecting the housing portion 162 of the fragmenting unit 16 and the housing portion 182 of the disentangling unit 18. The binder supplying unit 171 includes a screw feeder 174. By rotation of the screw feeder 174, it is possible to supply the binder P1 that is in the form of powder or particles into the pipe 172. The binder P1 supplied into the pipe 172 is mixed with first fibers and second fibers in the fragments M6 to turn into the mixture M7. The pipe 172 is a flow passage through which the mixture M7 of the fragments M6 and the binder P1 flows.

Figure 8:
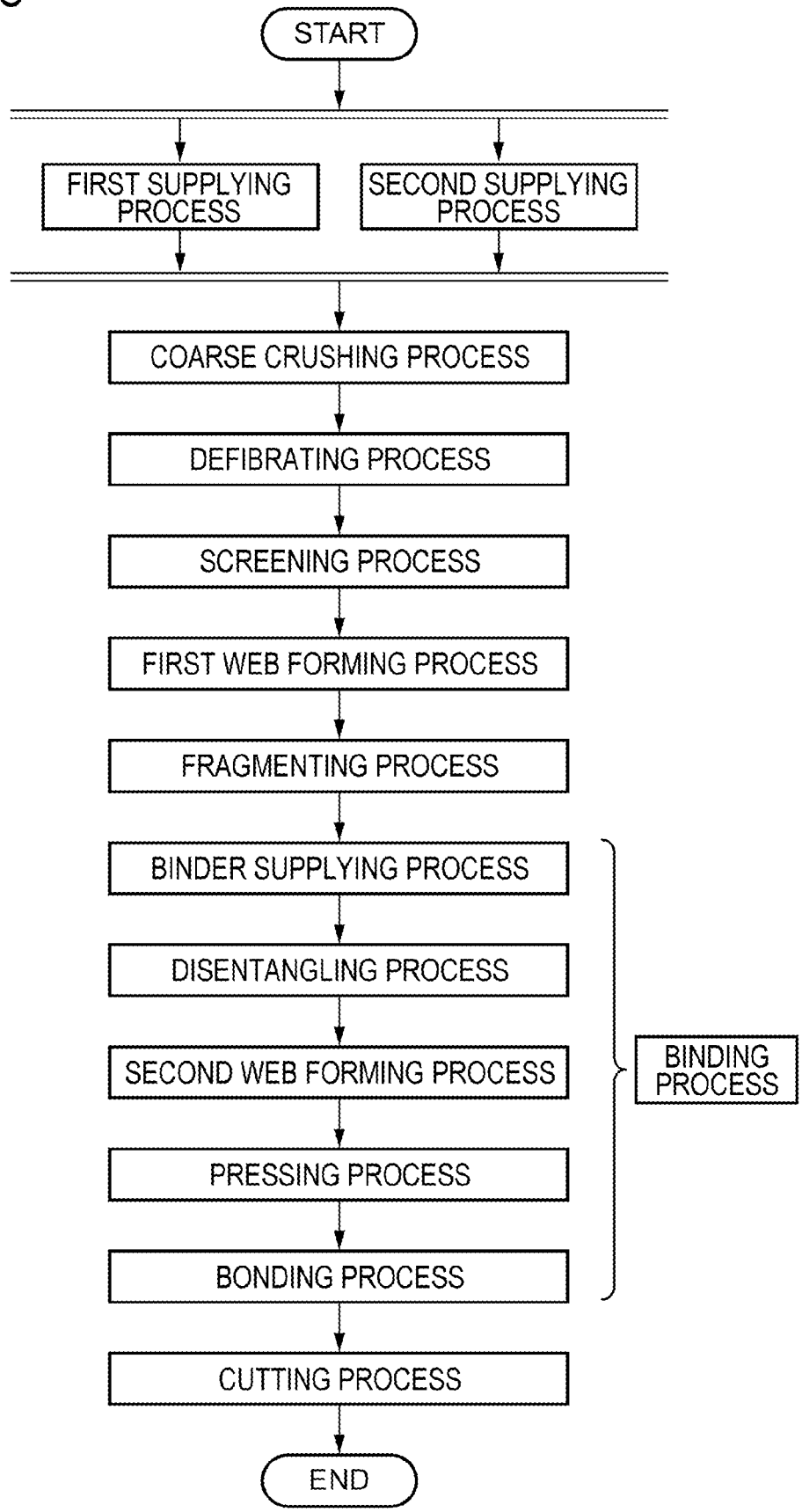
FIG. 8 is a flowchart for explaining a fibrous body manufacturing method for manufacturing recycled paper.

FIG. 8 is a flowchart that illustrates a fibrous body manufacturing method for manufacturing the first fibrous body S1 using the fibrous body manufacturing apparatus 100B.

The first raw material M1A containing a first fiber group is supplied in a first supplying process. The first supplying process is executed by the first supplying unit 11A.

In a second supplying process, the second raw material M1B containing a second fiber group having a length-average fiber length not less than a length-average fiber length of the first fiber group is supplied. The second supplying process is executed by the second supplying unit 11B.

Steps from the coarse crushing process to the fragmenting process, and from the disentangling process to the cutting process, are the same as those of the flow for manufacturing the first fibrous body S1 using the fibrous body manufacturing apparatus 100 described in the first embodiment. Therefore, these same steps are not explained here.

In a binder supplying process, the binder P1 for bonding the first fibers of the first fiber group and the second fibers of the second fiber group that constitute the fragments M6 is supplied, and the fragments M6 and the binder P1 are mixed together. The binder supplying process is executed by the mixing unit 17B.

The above-described steps from the binder supplying process to the bonding process constitute a binding process of bonding the first fibers of the first fiber group contained in the first raw material M1A and the second fibers of the second fiber group contained in the second raw material M1B using the fiber-bonding binder P supplied in the binder supplying process.

In the present embodiment, an example of the configuration of the fibrous body manufacturing apparatus 100B configured to supply the sheet-shaped first raw material M1A and the sheet-shaped second raw material M1B has been disclosed. However, the second raw material is not limited to such a sheet-shaped raw material. The second raw material may be a powdery fibrous material or a fiber block. If a powdery fibrous material is supplied as the second raw material, coarse crushing and defibration are unnecessary. Therefore, in this case, the first raw material M1A is coarsely crushed in the coarse crushing process, and the first raw material M1A is defibrated in the defibrating process. If the second raw material that is in powdery form is supplied, a fibrous material supplying unit configured to supply such a powdery fibrous material from a cartridge containing the powdery fibrous material is provided somewhere between the drum portion 141 and the drum portion 181.

2-1. Eighth Example

Next, with reference to FIG. 9, an example of manufacturing the first fibrous body S1 by the fibrous body manufacturing apparatus 100B using the fibrous body manufacturing method according to the present embodiment will now be explained.

FIG. 9 shows, from the top in this order, the first raw material M1A supplied in the first supplying process, the second raw material M1B supplied in the second supplying process, the amount of the second raw material M1B supplied, the amount of the binder P1 supplied, the first fibrous body S1 formed by the fibrous body manufacturing apparatus 100B, and evaluation results. The first raw material M1A is a sheet-shaped raw material containing the first fiber group, the principal ingredient of which is hardwood. The second raw material M1B is a sheet-shaped raw material containing the second fiber group, the principal ingredient of which is hardwood. The binder P1 for bonding fibers together is supplied from the binder supplying unit 171.

In the column of the example, supply conditions, including, the length-average fiber length LL [μm] of each of the first raw material M1A and the second raw material M1B supplied to the fibrous body manufacturing apparatus 100B, the number-average fiber length LN [μm] thereof, the mass ratio [%] of the second raw material M1B relative to the first raw material M1A, the mass ratio [%] of the binder P1 relative to the first raw material M1 plus the second raw material M1B, are shown; in addition to these supply conditions, the specific tensile strength [N·m/g] of the first raw material M1A and the specific tensile strength [N·m/g] of the first fibrous body S1 formed by the fibrous body manufacturing apparatus 100B are also shown. An evaluation result "A" is shown in the bottom row of the table of the eighth example.

In the eighth example, the first raw material M1A having a length-average fiber length of LL=800 μm and a number-average fiber length of LN=560 μm was supplied in the first supplying process, and the second raw material M1B having a length-average fiber length of LL=1,000 μm and a number-average fiber length of LN=700 μm was supplied in the second supplying process at a mass ratio of 20% relative to the first raw material M1A, and the binder P1 having a mass ratio of 6% relative to the first raw material M1 plus the second raw material M1B was supplied in the binder supplying process. With these conditions, the first fibrous body S1 in which the second raw material M1B is less than the first raw material M1A in terms of a mass ratio is formed.

The fiber length of the first raw material M1A and the fiber length of the second raw material M1B of the eighth example are the same as the fiber length of the first raw material M1A and the fiber length of the second raw material M1B of the first example described in the first embodiment. However, since the second raw material M1B of the eighth example does not contain the binder P1, the binder P1 whose amount is substantially the same as the amount of the binder P1 contained in the second raw material M1B of the first example described in the first embodiment was supplied from the binder supplying unit 171. The specific tensile strength of the first fibrous body S1 manufactured by the fibrous body manufacturing apparatus 100B using the fibrous body manufacturing method was I=23.2 N·m/g. Adding the second raw material M1B having a length-average fiber length greater than the length-average fiber length of the first raw material M1A and not containing the binder P1 to the first raw material M1A, which is a principal raw material, made it possible to obtain the first fibrous body S1, that is, recycled paper, having a specific tensile strength greater than the specific tensile strength of the first raw material M1A by more than 5%.

As can be seen from the results of the first example of the first embodiment and the eighth example, even if the binder P1 is added separately from the second raw material M1B, it is possible to manufacture the first fibrous body S1 having a specific tensile strength greater than the specific tensile strength of the first raw material M1A. That is, it is possible to obtain the first fibrous body S1 as recycled paper having a specific tensile strength greater than the specific tensile strength of the first raw material M1A as waste paper.

The first raw material M1A may contain a binder P1. For example, sheet-shaped fibers manufactured by a dry-type fibrous body manufacturing apparatus contain a binder P1 for bonding fibers together. In this case, the mass ratio of the binder P1 supplied in the binding process relative to the second raw material M1B is preferably greater than the mass ratio of the binder P1 contained in the first raw material M1A relative to the first raw material M1A. This makes it possible to further improve the specific tensile strength of the first fibrous body S1.

As explained above, the following effects can be obtained from the fibrous body manufacturing method according to the second embodiment.

A fibrous body manufacturing method includes: a first supplying process of supplying the first raw material M1A containing a first fiber group; a second supplying process of supplying the second raw material M1B containing a second fiber group having a length-average fiber length not less than a length-average fiber length of the first fiber group; and a binding process of bonding first fibers and second fibers together using the binder P to form the first fibrous body S1. With these processes, it is possible to provide a fibrous body manufacturing method that makes it possible to suppress the weakening of the specific tensile strength of the first fibrous body S1 in comparison with the first raw material M1A.

What is claimed is:

1. A fibrous body manufacturing method, comprising:

a first supplying step of supplying a first raw material containing a first fiber group;

a second raw material manufacturing step of manufacturing a second raw material by adding a binder to a second fiber group and forming the second raw material in sheet-shape, the second fiber group having a length-average fiber length not less than a length-average fiber length of the first fiber group, the binder being configured to bond fibers together;

a second supplying step of supplying the second raw material;

a defibrating step of defibrating the first raw material and the second raw material;

a forming step of forming a first deposited material by depositing a first mixed material containing the first raw material and the second raw material; and a bonding step of bonding first fibers of the first fiber group and second fibers of the second fiber group that are contained in the first deposited material together using the binder to form a first fibrous body.

2. The fibrous body manufacturing method according to claim 1, wherein a number-average fiber length of the second raw material is not less than a number-average fiber length of the first raw material.

3. The fibrous body manufacturing method according to claim 1, wherein when the first raw material also contains the binder, a mass ratio of the binder contained in the second raw material relative to the second raw material is greater than a mass ratio of the binder contained in the first raw material relative to the first raw material.

4. The fibrous body manufacturing method according to claim 1, further comprising:

a coarse crushing step of coarsely crushing the first raw material, or the first raw material and the second raw material, upstream of the defibrating step, wherein the first raw material has a sheet shape.

5. A fibrous body manufacturing method, comprising:

a first supplying step of supplying a first raw material containing a first fiber group;

a second raw material manufacturing step of manufacturing a second raw material by adding a binder to a second fiber group and forming the second raw material in sheet-shape, the binder being configured to bond fibers together;

a second supplying step of supplying the second raw material;

a defibrating step of defibrating the first raw material and the second raw material;

a forming step of forming a first deposited material by depositing a first mixed material containing the first raw material defibrated in the defibrating step and the second raw material; and a bonding step of bonding first fibers of the first fiber group and second fibers of the second fiber group that are contained in the first deposited material together using the binder to form a first fibrous body, wherein a specific tensile strength of the first fibrous body is not less than a specific tensile strength of the first raw material.

6. The fibrous body manufacturing method according to claim 5, wherein a length-average fiber length of the second raw material is not less than a length-average fiber length of the first raw material.

7. A fibrous body manufacturing method for manufacturing a second fibrous body using the first fibrous body manufactured using the fibrous body manufacturing method according to claim 5, comprising:

a third supplying step of supplying, as a third raw material, the first fibrous body containing a third fiber group;

a fourth supplying step of supplying a fourth raw material containing a fourth fiber group and a binder whose mass ratio is greater than a mass ratio of the binder contained in the first fibrous body;

a defibrating step of defibrating the third raw material;

a forming step of forming a second deposited material by depositing a second mixed material containing the first fibrous body defibrated in the defibrating step and the fourth raw material; and a bonding step of bonding third fibers of the third fiber group and fourth fibers of the fourth fiber group that are contained in the second deposited material together using the binder contained in the first fibrous body and the fourth raw material to form a second fibrous body, wherein a specific tensile strength of the second fibrous body is not less than a specific tensile strength of the first fibrous body.

8. A fibrous body manufacturing method, comprising:

a first supplying step of supplying a first raw material containing a first fiber group;

a second supplying step of supplying a second raw material containing a second fiber group having a length-average fiber length not less than a length-average fiber length of the first fiber group;

a first web forming step of forming a first web containing the first raw material and the second raw material;

a fragmenting step of fragmenting the first web into fragments of first fibers of the first fiber group and second fibers of the second fiber group;

a binder supplying step of supplying a binder to the fragments of the first fibers and the second fibers; and a binding step of bonding the first fibers and the second fibers together using the binder to form a first fibrous body, the binder being configured to bond fibers together; wherein in the first fibrous body, the second raw material is less than the first raw material in terms of a mass ratio.

9. The fibrous body manufacturing method according to claim 8, wherein when the first raw material contains the binder, a mass ratio of the binder supplied in the binding step relative to the second raw material is greater than a mass ratio of the binder contained in the first raw material relative to the first raw material.

10. The fibrous body manufacturing method according to claim 8, further comprising:

a defibrating step of defibrating the first raw material.

11. The fibrous body manufacturing method according to claim 8, further comprising:

a defibrating step of defibrating the first raw material and the second raw material.

* * * * *